United States Patent [19]

Badesha et al.

[11] Patent Number: 4,822,703

[45] Date of Patent: Apr. 18, 1989

[54] PHOTORESPONSIVE IMAGING MEMBERS WITH POLYGERMANES

[75] Inventors: Santokh S. Badesha, Pittsford; Milan Stolka, Fairport; Ronald J. Weagley, Penfield; Frederick J. Roberts, Jr., Webster, all of N.Y.

[73] Assignee: Xerox Corporation, Stamford, Conn.

[21] Appl. No.: 177,276

[22] Filed: Apr. 4, 1988

[51] Int. Cl.[4] ..... G03G 5/14

[52] U.S. Cl. ..... 430/58; 430/56

[58] Field of Search ..... 430/56, 58

[56] References Cited

U.S. PATENT DOCUMENTS

| | | | |
|---|---|---|---|
| 3,671,467 | 6/1972 | Gunther | 430/56 X |
| 3,962,141 | 6/1976 | Inoue et al. | 252/501.1 |
| 4,360,551 | 11/1982 | Guarino et al. | 428/35 |
| 4,405,702 | 9/1983 | Shirai et al. | 430/60 |
| 4,495,262 | 1/1985 | Matsuzaki et al. | 430/58 |
| 4,585,719 | 4/1985 | Saitoh et al. | 430/59 |
| 4,618,551 | 10/1986 | Stolka et al. | 430/58 |
| 4,737,379 | 4/1988 | Hudgens et al. | 427/39 |

*Primary Examiner*—Roland E. Martin

*Attorney, Agent, or Firm*—E. O. Palazzo

[57] ABSTRACT

A layered photoresponsive imaging member comprised of a supporting substrate, a photogenerating layer, and a hole transport layer in contact therewith, which layer is comprised of polygermane compounds or copolymers thereof.

21 Claims, 1 Drawing Sheet

PHOTORESPONSIVE IMAGING MEMBERS WITH POLYGERMANES

BACKGROUND OF THE INVENTION

This invention is generally directed to photoresponsive imaging members, and more specifically the present invention is directed to improved photoresponsive imaging members containing as hole transporting substances polygermane homopolymers, or copolymers of polygermanes and polysilylenes, as well as mixtures thereof. In one important embodiment of the present invention there is provided a layered photoresponsive imaging member comprised of a polygermane homopolymer or copolymer, a charge transporting layer and a photogenerating layer, which members are particularly useful in electrophotographic, including xerographic, imaging and printing processes. Further, there is provided in one particular aspect of the present invention an improved layered photoresponsive imaging member comprised of a supporting substrate, a photogenerating layer, and in contact therewith a hole transporting layer comprised of polygermane components. In addition, as charge transporting compounds there can be selected for the imaging members of the present invention the copolymers of polygermanes dispersed in organosilylenes. With further respect to the aforementioned imaging members, the polygermane or copolymer hole transporting compound layer can be located as the top layer of the imaging member of alternatively may be situated between the supporting substrate and the photogenerating layer. Moreover, the imaging members of the present invention are useful in electrophotographic, and especially xerographic imaging and printing processes, including particularly those wherein liquid developer compositions and dry developer compositions as selected for rendering the formulated image visible.

The formation and development of electrostatic latent images on the imaging surfaces of photoconductive materials by electrostatic means is well known. The photoreceptor selected may comprise a conductive substrate containing on its surface a layer or layers of photoconductive insulating materials, and in many instances there can be used a thin barrier layer situated between the substrate and the photoconductive layer to prevent charge injection from the substrate into the photoconductive layer upon charging. Numerous different photoconductive members for use in xerography are known, including for example a homogeneous layer of a single material such as vitreous selenium, or composite layered imaging members with a photoconductive compound dispersed in other substances. An example of one type of composite photoconductive layer used in xerography is described, for example, in U.S. Pat. No. 3,121,006 wherein there is disclosed a number of layers comprising finely divided particles of photoconductive inorganic compounds dispersed in an electrically insulating organic resin binder.

There are also known photoreceptor materials comprised of other inorganic or organic materials wherein the charge carrier generation and charge carrier transport functions are accomplished by discrete contiguous layers. Additionally, photoreceptor materials are disclosed in the prior art which includes an overcoating layer of an electrically insulating polymeric material, and in conjunction with this overcoated type photoreceptor there have been proposed a number of imaging methods. However, the art of xerography continues to advance, and more stringent demands need to be met by the copying apparatus to permit an increase in performance standards especially with liquid developer compositions, and to permit higher quality images. The photoconductive imaging member of the present invention represents such an improved member, and has other advantages as disclosed hereinafter.

Recently, there have been developed layered photoresponsive imaging members, including those comprised of generating layers and transport layers as disclosed in U.S. Pat. No. 4,265,990, and overcoated photoresponsive materials with a hole injecting layer overcoated with a transport layer, followed by an overcoating of a photogenerating layer and a top coating of an insulating organic resin, reference U.S. Pat. No. 4,251,612. Examples of photogenerating layers disclosed in these patents include trigonal selenium and metal, or metal free phthalocyanines. Illustrative examples of the transport compounds that may be employed are comprised of certain aromatic amines as mentioned therein. The disclosures of each of these patents, namely U.S. Pat. Nos. 4,265,990 and 4,251,612, are totally incorporated herein by reference. The 990 patent is of particular interest in that it discloses layered photoresponsive imaging members similar to those illustrated in the present application with the exception that the hole transporting substances of this patent are comprised of aryl amine compositions, while in accordance with the present invention the hole transporting substance is comprised of, for example, a polygermane.

Many other patents are in existence describing photoresponsive imaging members including layered imaging members with generating substances such as U.S. Pat. No. 3,041,167, which describes an electrophotographic imaging member with an overcoated imaging member containing a conductive substrate, a photoconductive insulating layer, and an overcoating layer of an electrically insulating polymeric material. This member is utilized in an electrophotographic copying method by, for example, initially charging the member with an electrostatic charge of a first polarity, and imagewise exposing to form an electrostatic latent image which can be subsequently developed to form a visible image.

In U.S. Pat. No. 3,041,116 there is disclosed a photoconductive material with a transparent plastic material overcoated on a layer of vitreous selenium, which is present on a recording substrate. Apparently, in operation the free surface of the transparent plastic is electrostatically charged to a desired polarity, followed by exposing the imaging member to activating radiation, which generates a hole electron pair in the photoconductive layer, and wherein the electrons move to the plastic layer and neutralize the positive charges contained on the free surface of the plastic layer, thus creating an electrostatic image. Also, there is disclosed in U.S. Pat. Nos. 4,232,102 and 4,233,383, the disclosures of which are totally incorporated herein by reference, the use of sodium carbonate doped and barium carbonate doped photoresponsive imaging members containing trigonal selenium. Other representative patents disclosing layered photoresponsive imaging members include U.S. Pat. Nos. 4,115,116; 4,047,949 and 4,081,274.

In addition, there are also known layered photoresponsive imaging members wherein there are selected various squaraine compounds, reference for example U.S. Pat. Nos. 4,552,822; 4,415,639; 4,471,041; and 4,486,520, the disclosures of each of these patents being totally incorporated herein by reference.

There are also illustrated in U.S. Pat. No. 4,618,551, the disclosure of which is totally incorporated herein by reference, photoresponsive imaging members comprised, for example, of supporting substrates and charge transport layers containing therein polysilylenes. More specifically, there is illustrated in the aforementioned patent a polysilylene hole transporting compound for use in imaging members, which compound is of the formula as illustrated in claim 1 with specific examples of polysilylenes being poly(methylphenyl silylene) of an average molecular weight of greater than 50,000.

Although imaging members with various hole transporting substances, including aryl amines and polysilylenes, are suitable for their intended purposes, there continues to be a need for improved members, particularly layered members which are comprised of specific polygermanes, and copolymers thereof, and which are compatible with a variety of photogenerating pigments. There is also a need for improved imaging members with specific polygermanes that possess low ionization potentials thereby enabling the effective and efficient transporting of the holes in the imaging members.

Moreover, there continues to be a need for specific layered imaging members which not only generate acceptable images, but which can be repeatedly used in a number of imaging cycles without deterioration thereof from the machine environment or surrounding conditions. Additionally, there continues to be a need for improved layered imaging members wherein the materials employed for the respective layers, particularly the hole transporting layer, are substantially inert to the users of these members. Further, there continues to a need for improved photoresponsive imaging members which can be prepared with a minimum number of processing steps, and wherein the layers are sufficiently adhered to one another to allow the continuous use of these imaging members in repetitive imaging processes. Also, there continues to be a need for new hole transporting compounds that are also useful as protective overcoating layers, and as interface materials for various imaging members. There also is a need for new hole transporting substances which enable increased mobility of holes in layered imaging members. Likewise, there is a need for hole transporting compounds with increased stability, for example, wherein there is no extraction of these compounds from the layered imaging members in which they are incorporated when, for instance, liquid developers are selected for rendering the latent electrostatic latent image visible. Furthermore, there is a need for hole transporting compounds useful in layered imaging members, which compounds are superior insulators in the dark compared to may other known hole transporting compounds, thus enabling charging of the resulting imaging member to higher fields while maintaining cyclic stability, and allowing improved developability. Also, there is a need for imaging members with new hole transporting compounds which can function as resinous binders. Additionally, there is a need for enabling the preparation of imaging members with polygermane hole transporting compounds, or copolymers thereof, which preparation allows for the selection of a variety of solvents, inclusive of toluene, benzene, tetrahydrofuran, cyclohexane, and halogenated solvents in addition to methylene chloride.

SUMMARY OF THE INVENTION

It is an object of the present invention to provide imaging members with many of the above noted advantages.

In another object of the present invention there are provided layered photoresponsive imaging members containing therein polygermane, or copolymers thereof hole transporting substances.

In a further object of the present invention there are provided improved photoresponsive imaging members with a photogenerating layer situated between a supporting substrate and a hole transporting layer comprised of the polygermanes or copolymers thereof illustrated herein.

In yet another object of the present invention there are provided improved photoresponsive imaging members comprised of polygermane or copolymers thereof hole transporting compounds layers situated between a supporting substrate and a photogenerating layer or layers.

In yet still another object of the present invention there are provided improved photoresponsive imaging members comprised of hole transporting compounds and photogenerating layers in contact therewith wherein the hole transporting compounds are comprised of polygermane homopolymers or copolymers of polygermanes with organosilylenes.

In yet another object of the present invention there are provided polygermane hole transporting compounds which are compatible with a variety of photogenerating pigments, and which polygermanes possess a low ionization potential.

Furthermore, in another object of the present invention there are provided polygermane hole transporting compounds that enable the efficient and effective movement of holes when present in an imaging member.

Moreover, in another object of the present invention there are provided electrophotographic imaging processes including xerographic imaging and printing processes utilizing the improved imaging members illustrated herein.

These and other objects of the present invention are accomplished by the provision of imaging members comprised of polygermanes or copolymers thereof. More specifically, the present invention is directed to an improved photoresponsive imaging member comprised of a photogenerating layer, and in contact therewith a hole transport layer comprised of polygermanes or copolymers thereof.

In one specific embodiment, the present invention is directed to an improved photoresponsive imaging member comprised of a supporting substrate, a photogenerating layer comprised of inorganic or organic photoconductive pigments optionally dispersed in an inactive resinous binder, and in contact therewith a hole transporting layer comprised of polygermane compounds of the following formulas dispersed in inactive resinous binders.

I. Polygermane Homopolymer

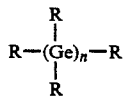

wherein n represents the number of monomer segments, and generally is a number of from about 20 to about 1,000, and preferably a number of from about 20 to about 200; and II. Polygermane Copolymers

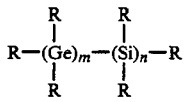

wherein m represents the number of monomer segments, and generally is a number of from about 5 to about 500, and preferably from about 5 to about 200; n is a number of from 5 to about 1,000, and preferably from about 5 to about 300; and wherein each R is independently selected from the group consisting of alkyl, aryl, substituted alkyl, substituted aryl, alkoxy, and halogen. The values of n and m, or the weight average molecular weight of the aforementioned homopolymers and copolymers can be determined by GPC, while the structures thereof are further confirmed by IR, NMR, and elemental analysis.

Examples of alkyl groups include those that are linear, or branched of from 1 carbon atom to about 24 carbon atoms, and preferably from 1 carbon atom to about 8 carbon atoms, inclusive of methyl, ethyl, propyl, butyl, amyl, hexyl, octyl, nonyl, decyl, pentadecyl, stearyl; and unsaturated alkyls inclusive of alkanes, and other similar substituents. Specific preferred alkyl groups are methyl, ethyl, propyl, and cyclohexyl butyl. Aryl substituents include those of from 6 carbon atoms to about 24 carbon atoms, inclusive of phenyl, naphthyl, anthryl, and the like. These alkyl and aryl groups may be substituted with alkyl, aryl, halogen, nitro, amino, alkoxy, cyano, and other related substituents. Example of alkoxy groups include those with from 1 carbon atom to about 10 carbon atoms, such as methoxy, ethoxy, propoxy, butoxy, and other similar substituents. Halogen substitutents for the polygermanes include chloride, bromide, iodide, and fluoride. The R substituents may represnt other groups providing the objectives of the present invention are achievable.

Illustrative specific examples of polygermane and copolymers of polygermanes, and polysilylenes hole transporting compounds included within the scope of the present invention are poly(di-n-butyl germane), poly(cyclohexylmethyl germane), poly(phenylmethyl germane), poly(n-propylmethyl germane), poly(diphenyl germane), poly(methylphenoxy germane), poly(-tolylmethyl germane), poly(chlorophenyl germane), poly(methylphenyl germane-co-methylphenyl silylene), poly(methylphenyl silylene-co-dimethyl germane silylene), poly(cyclohexylmethyl germane-co-cyclohexylmethyl silylene), poly(tertiary-butylmethyl germane-co-tertiarybutylmethyl silylene), poly(phenylethyl germane-co-phenylethyl silylene), poly(n-propylmethyl germane-co-n-propylmethyl silylene), poly(p-tolylmethyl germane-co-p-tolylmethyl silylene), poly(cyclotrimethylene germane-co-cyclotrimethylene silylene), poly(cyclotetramethylene germane-co-cyclotetramethylene silylene), poly(cyclopentamethylene germane-co-cyclopentametylene silylene), poly(di-t-butyl silylene-co-di-methyl germane silylene), poly(diphenyl silylene-co-phenylmethyl germane silylene), poly(-cyanoethylmethyl germane-co-cyanoethylmethyl silylene), poly(2-acetoxyethylmethyl germane-co-2-acetoxyethylmethyl silylene), poly(2-carbomethoxyethylmethyl germane-co-2-carbomethoxyethylmethyl silylene, poly(phenylmethyl germane-co-phenylmethyl silylene), and the like.

BRIEF DESCRIPTION OF THE DRAWINGS

For a better understanding of the present invention and further features thereof, reference is made to the following detailed description of various embodiments wherein.

As optional overcoatings for these members, there can be selected an aryl amine dispersed in a resin binder, inclusive of polycarbonates containing carbon black, polymers, amorphous carbon, silicon nitrides, and the like. The carbon black is usually present in various amounts, however, from about 5 percent to about 15 percent of carbon black is preferred.

DESCRIPTION OF THE PREFERRED EMBODIMENTS

Figure 1:
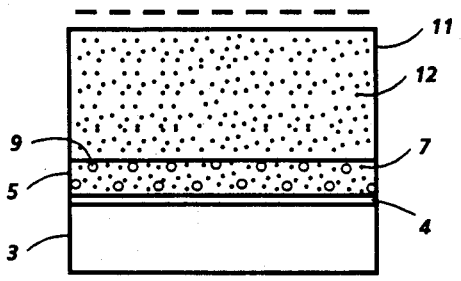
FIG. 1 is a partially schematic cross-sectional view of the improved photoresponsive imaging member of the present invention.

Illustrated in FIG. 1 is an improved photoresponsive imaging member of the present invnetion comprising a supporting substrate 3; an optional adhesive blocking layer 4; a charge carrier photogenerating layer 5 comprised of photogenerating pigment 7 optionally dispersed in an inactive resinous binder composition 9; and a charge or hole transport layer 11 comprised of a polygermane hole transporting compound 12 illustraed herein. In an alternative embodiment of the present invention, and with further regard to FIG. 1, the hole transporting layer can be situated between the supporting substrate and the photogenerating layer resulting in a positively charged imaging member.

Figure 2:
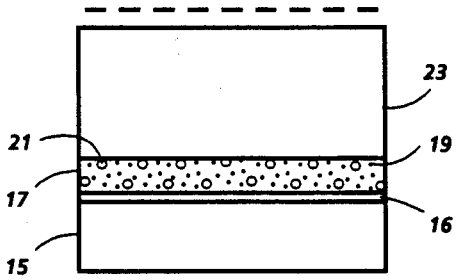
FIG. 2 represents a partially schematic cross-sectional view of a photoresponsive imaging member of the present invention.

Illustrated in FIG. 2 is a negatively charged photoresponsive imaging member of the present invention comprised of a conductive supporting substrate 15 of aluminized Mylar; an optional adhesive blocking layer 16; a photogenerating layer 17 comprised of a trigonal selenium photogenerating pigment 19; or other similar inorganic pigments as well as organic pigments dispersed in a resinous binder 21; and a hole transport layer 23 comprised of the polygermane of Formulas I or II.

Figure 3:
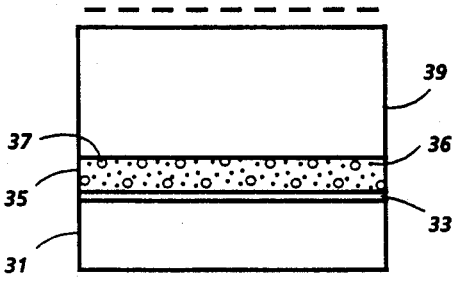
FIG. 3 represents a partially schematic cross-sectional view of a photoresponsive imaging member of the present invention including therein an optional/-blocking adhesive layer.

Illustrated in FIG. 3 is a negatively charged photoresponsive imaging member of the present invention comprised of a conductive supporting substrate 31 of aluminized Mylar; an optional adhesive blocking layer 33; a photogenerating layer 35 comprised of inorganic or organic photogenerating pigment 36 inclusive of trigonal selenium, vanadyl phthalocyanine, cadmium sulfur selenide dispersed in a resinous binder 37, and a hole transport layer 39 comprised of the polygermane of Formulas I or II, wherein n is 100, and m is 75; and preferably the polygermane poly(di-n-butylgermane).

Figure 4:
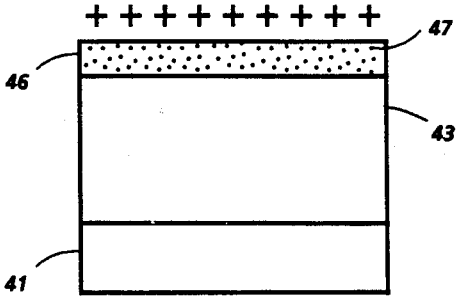
FIG. 4 represents a partially schematic cross-sectional view of a photoresponsive imaging member of the present invention wherein the hole transporting compound is situated between a supporting substrate and a photogenerating layer.

Illustrated in FIG. 4 is a positively charged photoresponsive imaging member of the present invention comprised of a conductive supporting substrate 41 of aluminized Mylar; a hole transporting layer 43 comprised of the polygermanes illustrated herein; a photogenerating layer comprised of photogenerating pigments 46 inclusive of amorphous selenium, trigonal selenium, metal phthalocyanines, metal free phthalocyanines, vanadyl phthalocynines, cadmium-sulfur selenide, optionally dispersed in a resinous binder 47, and wherein the amount of resinous binder present in the photogenerating layer is from about 5 percent to about 25 percent, and the amount of resinous binder present in the hole transport layer is from about 45 percent to about 65 percent.

The supporting substrate layers may be opaque or substantially transparent, and may comprise any suitable material having the requisite mechanical properties. Thus, the substrate may comprise a layer of nonconducting material such as an inorganic or organic polymeric material; a layer of an organic or inorganic material having a conductive surface layer arranged thereon or a conductive material such as, for example, aluminum, chromium, nickel, indium, tin oxide, brass or the like. The substrate may be flexible or rigid, and may have any of many different configurations such as, for example, a plate, a cylindrical drum, a scroll, an endless flexible belt, and the like. Preferably, the substrate is in the form of an endless flexible belt. The thickness of the substrate layer depends on many factors including economical considerations. Thus, this layer may be of substantial thickness, for example, over 100 mils or minimum thickness providing there are no adverse effects on the system. In one preferred embodiment, the thickness of this layer ranges from about 3 mils to about 10 mils.

Examples of the photogenerating pigments are as illustrated herein, inclusive of amorphours selenium, selenium alloys, such as $As_2Se_3$, trigonal selenium, metal free phthalocyanines, metal phthalocyanines, vanadyl phthalocyanines, squaraines, and the like, with $As_2Se_3$ being preferred. Typically, this layer is of a thickness of from about 0.3 micron to about 10 microns or more, however, dependent on the photoconductive volume loading, which may vary from 5 to 100 volume percent, this layer can be of other thicknesses. Generally, it is desirable to provide this layer in a thickness which is sufficient to absorb about 90 percent or more of the incident radiation which is directed upon it in the imagewise exposure step. The maximum thickness of this layer is dependent primarily upon factors such as mechanical considerations, for example whether a flexible photoresponsive imaging member is desired.

Optional resin binders for the photogenerating pigments are, for example, the polymers as illustrated in U.S. Pat. No. 3,121,006, the disclosure of which is totally incorporated herein by reference, polyesters, polyvinyl butyrals, polyvinyl carbazoles, polycarbonate resins, epoxy resins, polyhydroxyether resins, and the like. This layer can be of other thicknesses providing the objectives of the present invention are achieved; thus, for example, when evaporated photogenerating pigments are selected the thickness of this layer is from about 0.5 micron to about 3 microns.

Polysilylenes, which can be selected as the binder resinous components for the photogenerating pigments or for the hole transport polygermane components, are illustrated in U.S. Pat. No. 4,618,551, the disclosure of which is totally incorporated herein by reference.

The polygermanes are prepared as illustrated hereinafter, and generally result from the reaction of a dihalo disubstituted germane of the formula

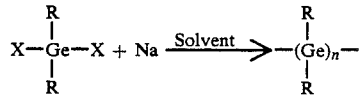

wherein R is as defined herein, and can, for example, be an aryl or alkyl substituent; and X is a halogen such as chlorine, bromine, fluorine, iodine, or mixtures thereof with an alkali metal, such as sodium in the presence of a suitable solvent inclusive of toluene, xylene, benzene, cyclohexene, cyclopentene, or mixtures thereof, with the preferred solvent being toluene. For each mole of the monomer selected about 2 moles of the sodium and about 800 milliliters of solvent are utilized. Further, the alkali metal such as sodium can be in the form of chunks, or can be selected as a dispersion (from about 10 to about 50 percent by weight in a solvent or other material such as toluene, light oil, or mineral oil). A preferred dispersion is comprised of 40 percent by weight of alkali metal, such as sodium, in a light oil.

The copolymers are generally prepared by the reaction of a germane monomer and silane monomer, which monomers are of the formula

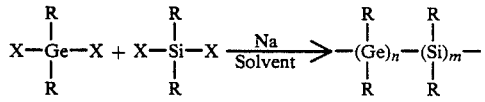

wherein R and X are as defined herein with an alkali metal in the presence of a solvent. Generally, the monomers are selected in a 1:1 molar ratio. In one process embodiment, about 4 moles of an alkali metal such as sodium is added to a solvent such as toluene with stirring and heating initiated for 10 minutes to about 1 hour. Thereafter, about 1 mole of each of the aforementioned monomers is mixed and added to the sodium mixture over a period of from about 10 minutes to about 2 hours. Heating is continued at a temperature of about 130° C. with stirring under argon for about 1 to about 10 hours, and thereafter the desired product is separated from the reaction mixture, purified, and identified by the procedure as illustrated herein with respect to the preparation of the polygermanes.

The imaging members of the present invention are useful in various electrophotographic imaging systems especially electrostatographic, including xerographic, imaging and printing systems wherein an electrostatic image can be formed on a photoresponsive imaging member, followed by the development thereof with a dry toner, reference for example U.S. Pat. No. 4,560,635, the disclosure of which is totally incorporated herein by reference, or known liquid toner compositions, transfer to a suitable substrate, and fixing of the resulting image.

The invention will now be described in detail with respect to specific preferred embodiments thereof, it being understood that these examples are intended to be illustrative only. The invention is not intended to be limited to the materials, conditions, process parameters, etc. recited herein. All parts and percentages are by weight unless otherwise indicated.

EXAMPLE I

Preparation of Poly(di-n-butyl germane)

To a 250 milliliter three-neck round bottom flask, which is equipped with a stirring motor, a condenser, and a pressure equilizing addition funnel, 8 grams (0.347 mole) of freshly cut sodium is added, followed by the addition of 80 milliliters of freshly distilled toluene. The contents of the flash are then heated and stirred under argon atomosphere in an oil bath, which is maintained at 130° C., which stirring and heating is continued for 20 minutes. Thereafter, there is added dropwise to the flash 41.2 grams (0.166 moles) of dichloro(di-n-butyl germane) over a 10 minute period, and the color of the reaction mixture is dark blue. The stirring and heating is continued for 3 hours, and the reaction mixture is then filtered hot under dry argon atmosphere. The precipitate is discarded and the clear filtrate, which is a solution of polygermane in toluene, is collected. This clear solution is then added to 800 milliliters of isopropanol over a 15 minute period. The white fluffy polymer (3.6 grams) is collected on filtration and dried under vacuum. GPC analysis indicated the molecular weight to be 220,000, and elemental analysis indicated the polymer to be poly(di-n-butylgermane).

EXAMPLE II

Preparation of Poly(di-n-butyl germane)

The synthesis in Example I is repeated with the variation that 0.32 moles of sodium dispersion of light oil (40 percent by weight sodium (contents) is used. The yield of the poly(di-n-butyl germane) is 13 percent. The molecular weight as determined by GPC is 290,000.

EXAMPLE III

Preparation of Poly(di-n-hexyl germane)

The process of Example I is repeated with the exception that the monomer is dichloro(di-n-hexyl germane). The color of the reaction mixture of the addition of the monomer is purple. The yield of the polymer is 9 percent and GPC showed the molecular weight to be 75,000.

EXAMPLE IV

Preparation of Poly(di-n-butyl germane)-co-(phenylmethyl silane)

Prepared by the method described by P. Trefonas and R. West in Journal of Polymer Chemistry, Polymer Chemistry Edition 23, 2099(1985), the disclosure of which is totally incorporated herein by reference.

A 250 milliliter three-neck round bottom flask is equipped with a water condenser, stirring motor, and 100 milliliter pressure-equalized addition funnel. 100 milliliters of dry toluene is added to the flash and 9.2 grams (0.4 mole) of sodium metal is added to the flask. The temperature of the oil bath is then raised to 130° C., and sodium metal stirred vigorously. A mixture of dichloro(di-n-butyl germane) (25.7 grams, 0.1 mole) and dichlorophenylmethyl silane (9.1 grams, 0.1 mole) is then added dropwise to the stirring sodium over a 20 minute period. At the end of the addition, the color of the reaction mixture turns dark blue. The contents of the flask are then filtered and the filterate, which is a clear solution, is then added dropwise to 900 milliliters of isopropanol. The polymer is then collected by filtration as white solid. GPC analysis showed the molecular weight to be 590,000.

Imaging members as illustrated herein, reference for example FIGS. 1 to 4, can be prepared as detailed in U.S. Pat. No. 4,618,551, the disclosure of which is totally incorporated herein by reference. It is believed that these members, especially those with poly(di-n-butyl germane), will enable images of excellent resolution, and no background deposits subsequent to development with a known dry or liquid toner composition.

Although the invention has been described with reference to specific preferred embodiments, it is not intended to be limited thereto; rather, those skilled in the art will recognize variations and modifications may be made therein which are within the spirit of the invention and within the scope of the following claims.

What is claimed is:

1. A layered photoresponsive imaging member comprised of a supporting substrate, a photogenerating layer, and a charge transport layer in contact therewith, which layer is comprised of polygermane compounds or copolymers thereof.

2. An imaging member in accordance with claim 1 wherein the polygermane is of the formulas

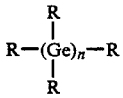

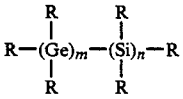

wherein R substituent is independently selected from the group consisting of alkyl, aryl, subsituted alkyl, and substituted aryl; and m and n represent the number of monomer segments.

3. An imaging member in accordance with claim 2 wherein m represents a number of from about 5 to about 500; and n represents a number of from about 5 to about 1,000.

4. An imaging member in accordance with claim 2 wherein m represents a number of from about 5 to about 200; and n represents a number of from about 5 to about 300.

5. An imaging member in accordance with claim 2 wherein the alkyl substituents contain from about 1 to about 25 carbon atoms.

6. An imaging member in accordance with claim 2 wherein the alkyl substituents contain from about 1 to about 16 carbon atoms.

7. An imaging member in accordance with claim 2 wherein the alkyl substituent is a methyl.

8. An imaging member in accordance with claim 2 wherein the aryl substituents contain from about 6 to about 24 carbon atoms.

9. An imaging member in accordance with claim 2 wherein the aryl substituents are phenyl.

10. An imaging member in accordance with claim 2 wherein the polygermane is poly(di-n-butyl germane).

11. An imaging member in accordance with claim 2 wherein the polygermane is poly(cyclohexylmethyl germane).

12. An imaging member in accordance with claim 2 wherein the polygermane is poly(phenylmethyl germane).

13. An imaging member in accordance with claim 2 wherein the polygermane is poly(diphenyl germane).

14. An imaging member in accordance with claim 1 wherein the photogenerating layer is comprised of photogenerating pigments selected from inorganic photoconductive pigments and organic photoconductive pigments.

15. An imaging member in accordance with claim 14 wherein the inorganic pigments are selected from the group consisting of amorphous selenium, selinium alloys, and trigonal selenium.

16. An imaging member in accordance with claim 14 wherein the organic pigments are selected from the group consisting of metal phthalocyanines, metal free phthalocyanines, and vanadyl phthalocyanines.

17. An imaging member in accordance with claim 1 wherein the supporting substrate is selected from organic polymeric compositions and conductive substances.

18. An imaging member in accordance with claim 1 wherein the supporting substrate is aluminized Mylar.

19. A process for generating electrostatic latent images which comprises providing the imaging member of claim 1, forming thereon electrostatic latent images, thereafter accomplishing the development of this image, subsequently transferring the image to a suitable substrate, and optionally affixing the image thereto.

20. A process for generating electrostatic latent images which comprises providing the imaging member of claim 2, forming thereon electrostatic latent images, thereafter accomplishing the development of this image, subsequently transferring the image to a suitable substrate, and optionally affixing the image thereto.

21. An imaging member in accordance with claim 2 wherein the polygermane polysilylene copolymer is selected from the group consisting of poly(methylphenyl germane-co-methylphenyl silylene), poly(methylphenyl silylene-co-dimethyl germane silylene), poly(cyclohexylmethyl germane-co-cyclohexylmethyl silylene), poly(tertiary-butylmethyl germane-co-tertiarybutylmethyl silylene), and poly(phenylethyl germane-co-phenylethyl silylene)

* * * * *